US006536050B1

(12) United States Patent
Hill

(10) Patent No.: US 6,536,050 B1
(45) Date of Patent: Mar. 25, 2003

(54) DEVICE TO PROTECT HAND/WRIST WHEN USING HAND HELD POWER ACTUATED FASTENER GUN

(76) Inventor: Jerrold W. Hill, 16 Highpoint Rd., Round Lake, IL (US) 60073

( * ) Notice: Subject to any disclaimer, the term of this patent is extended or adjusted under 35 U.S.C. 154(b) by 108 days.

(21) Appl. No.: 09/705,280

(22) Filed: Nov. 2, 2000

(51) Int. Cl.[7] ..... A41D 19/00
(52) U.S. Cl. ..... 2/161.6; 2/16; 2/160
(58) Field of Search ..... 2/16, 20, 160, 2/161.1, 161.6, 162, 163, 455; 473/54, 60; 128/878, 879; 602/21

(56) References Cited

U.S. PATENT DOCUMENTS

| | | | | | |
|---|---|---|---|---|---|
| 4,137,572 | A | | 2/1979 | Jansson | |
| 4,138,108 | A | * | 2/1979 | Robinson | 273/54 |
| 4,873,998 | A | | 10/1989 | Joyner | |
| 4,941,460 | A | | 7/1990 | Working | |
| 4,942,626 | A | | 7/1990 | Stern | |
| 5,231,700 | A | | 8/1993 | Cutshall | |
| 5,339,465 | A | * | 8/1994 | Kyewski | 2/20 |
| 5,450,626 | A | | 9/1995 | Sorrels | |
| 5,459,878 | A | * | 10/1995 | Gold | 2/161.1 |
| 5,517,692 | A | | 5/1996 | Wunderlich-Kehm | |
| 5,604,931 | A | * | 2/1997 | Rhoades | 2/16 |
| D385,666 | S | | 10/1997 | Abreu | |
| 5,745,919 | A | | 5/1998 | Kraatz | |
| 5,769,804 | A | | 6/1998 | Harris et al. | |
| 5,898,936 | A | * | 5/1999 | Janes | 2/16 |
| 5,974,588 | A | | 11/1999 | Furman | |
| 5,987,641 | A | * | 11/1999 | Walker | 2/16 |
| 6,012,165 | A | | 1/2000 | Cain | |
| 6,038,697 | A | | 3/2000 | Kasarnich | |
| 6,049,022 | A | | 4/2000 | Tseng et al. | |

* cited by examiner

*Primary Examiner*—Peter Nerbun
*Assistant Examiner*—Katherine Moran
(74) *Attorney, Agent, or Firm*—Charles F. Meroni, Jr.; P. Derek Pressley; Meroni & Meroni, P.C.

(57) ABSTRACT

A device to protect the wearer's wrist and hand between the wearer's thumb and index finger from the localized repetitive impact associated with operating a hand held power actuated gun is disclosed. The device comprises an adjustable glove for the hand, wrist, and lower forearm which provides a gap to allow adjustment to the wearer's lower forearm, wrist and hand. The glove is secured on the wearer's forearm, wrist, and hand by adjustable fasteners situated across the gap that runs along the back side of the glove. A pocket is provided on the palm side of the adjustable glove that engages a padded reinforcement member which extends from the forearm of the wearer to the mid-palm area of the wearer and across the palm toward the thumb, covering both the palm and side of the hand from the from the first joint of the index finger to the midpoint between the first and second joints of the thumb, between the index finger and thumb.

26 Claims, 3 Drawing Sheets

DEVICE TO PROTECT HAND/WRIST WHEN USING HAND HELD POWER ACTUATED FASTENER GUN

BACKGROUND OF THE INVENTION

1. Field of the Invention

The present invention relates to a device for the hand and wrist which is especially intended for use with hand held power actuated fastener guns designed to protect the wrist and the hand between the thumb and index finger from the recoil impact imparted on the hand during operation of a hand held power actuated fastener gun.

2. Description of the Prior Art

The use of gloves and braces to protect a wearer from injury to the hand or wrist is well known in the prior art. The prior art in this area generally consists of gloves to protect the wearer's hand and braces that protect the wearer's wrist.

There are several gloves that protect the wearer's hand from cuts, punctures, or blows in the prior art. Some examples are U.S. Pat. Nos. 5,745,919, 5,231,700, and 5,974,588. U.S. Pat. No. 5,745,919 issued to Kraatz discloses a cut-resistant protective glove with leather sheath that protects the wearer's hand from cuts. U.S. Pat. No. 5,231,700 issued to Cutshall discloses a penetration resistant hand protector for medical applications that protects the wearer's hand from punctures during medical procedures. U.S. Pat. No. 5,974,588 issued to Furman discloses a protective glove for protecting the hand of a wearer from injury from blows impacting the hand. Furman provides a glove that has a fingertip shield adjacent the tip of each finger, and a knuckle shield on the back face of the glove to protect the hand overall from blows generally aimed at the hand. While the prior art in this area may protect the hand from cuts, punctures, or blows directed generally to the hand, they do not protect the wearer's wrist and hand between the wearer's thumb and index finger from the localized repetitive impact associated with the recoil impact imparted on the hand during operation of a hand held power actuated fastener gun.

There are several braces that protect the wrist from injury due to repetitive motion. Two examples are U.S. Pat. Nos. 5,769,804 and 4,941,460. U.S. Pat. No. 5,769,804 is a carpal tunnel syndrome wrist brace that immobilizes the wrist to prevent further injury. U.S. Pat. No. 4,941,460 is a carpal brace which permits the full use of the fingers while preventing further injury. While the prior art in this area may protect the wrist from repetitive motion injuries, they do not protect the wearer's wrist and hand between the wearer's thumb and index finger from the localized repetitive impact associated with the recoil impact imparted on the hand during operation of a hand held power actuated fastener gun.

SUMMARY OF THE INVENTION

Accordingly, it is the object of the claimed invention to provide a device to protect the wearer's wrist and hand between the wearer's thumb and index finger from the localized repetitive impact associated with operating a hand held gun powered by gun powder, electricity, pneumatics, and other like sources of power that drives fasteners such as nails, staples, rivets, and other like fasteners.

To attain this objective, the claimed invention generally comprises an adjustable glove for the hand, wrist, and lower forearm made of a flexible material which covers the lower portion of the forearm, wrist, and hand. The material is separated on the back side of the glove forming a gap from the open end of the glove to about the wrist. The gap allows persons of different sizes to secure the glove on the lower forearm, wrist, and hand by either expanding or narrowing the gap. The glove is secured on the wearer's lower forearm, wrist, and hand by adjustable fasteners such as Velcro® and or laces situated across the gap that runs along the back side of the glove. Each finger of the glove has an opening through which the wearer's fingers extend.

The glove has a pocket on the palm side of the glove capable of engaging a padded reinforcement member that extends from the inside of the forearm to the mid-palm area and across the palm toward the thumb, covering both the palm and side of the hand from the first joint of the index finger to the midpoint between the first and second joints of the thumb, between the index finger and thumb.

A padded reinforcement member made of a rigid material and covered with a padding material is engaged within the pocket of the glove. The padded reinforcement member extends from the forearm of the wearer to the mid-palm area of the wearer and across the palm toward the thumb, covering both the palm and side of the hand from the from the first joint of the index finger to the midpoint between the first and second joints of the thumb, between the index finger and thumb. The portion of the padded reinforcement member that protects the area from the forearm to the mid-palm is contoured to fit the natural curvatures of the hand. The portion of the padded reinforcement member that protects the palm and side of the hand from the first joint of the index finger to the midpoint between the first and second joints of the thumb, between the index finger and thumb is configured to accommodate the curved handle design that hand held power actuated fastener guns commonly have. The padded reinforcement member transfers the recoil impact from the operation of the hand held power actuated fastener gun to the upper forearm and the upper arm.

The reinforcement member protects many of the bones, muscles, tendons, and nerves of the hand and wrist from the localized repetitive impact associated with the recoil impact imparted on the hand during operation of a hand held power actuated fastener gun.

DETAILED DESCRIPTION OF THE PREFERRED EMBODIMENT

Figure 1:
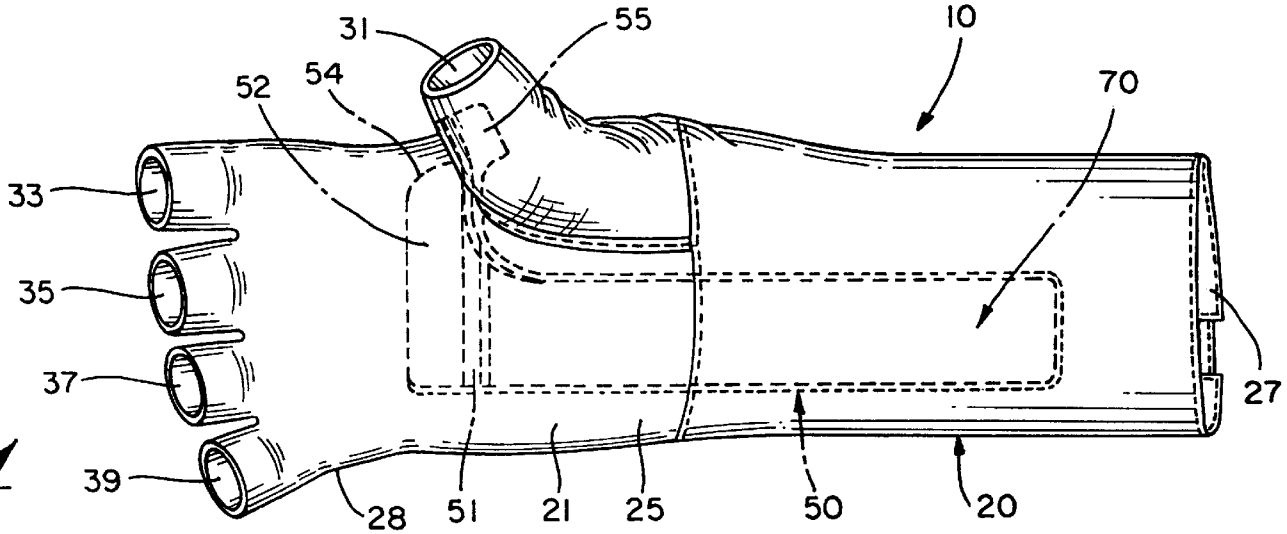
FIG. 1 is a plan view of the palm side of the device.
Figure 2:
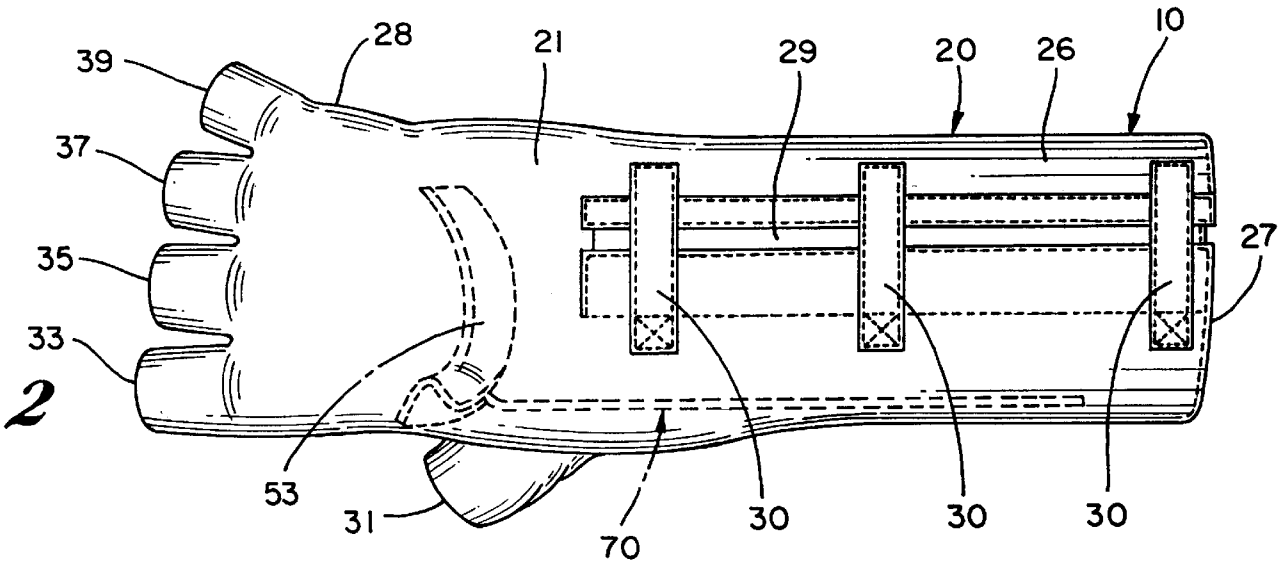
FIG. 2 is a plan view of the back side of the device.
Figure 6:
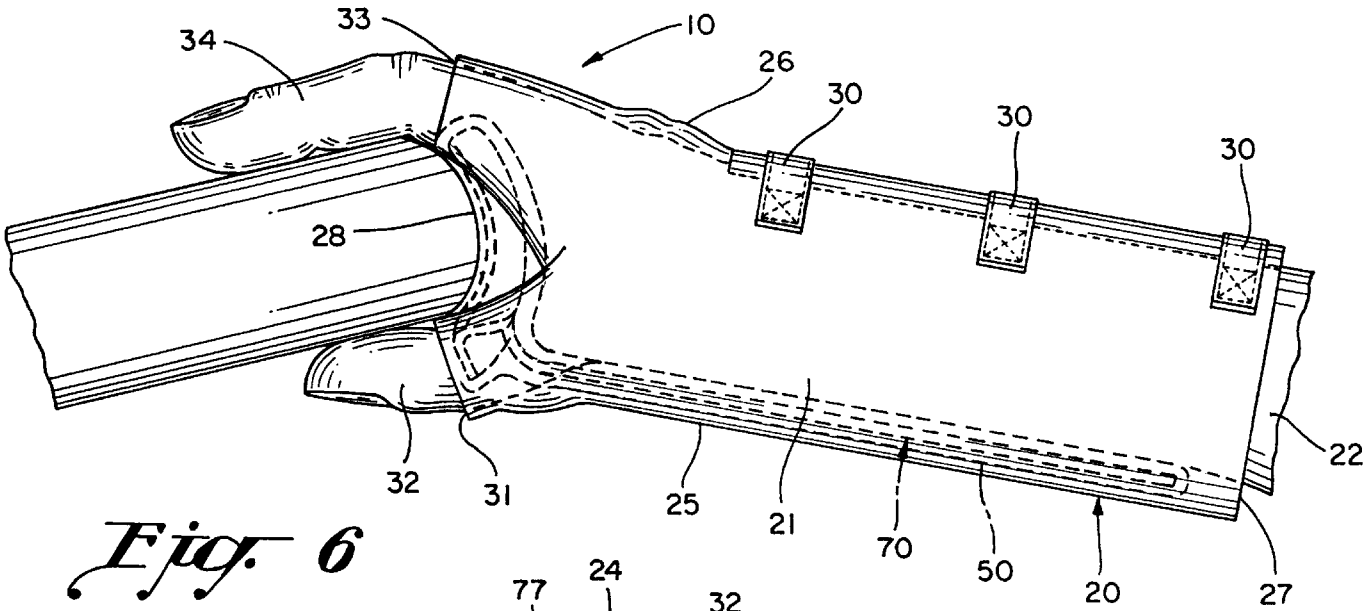
FIG. 6 is a top view of a person wearing the device while grasping a hand held power actuated fastener gun.

Referring now to the drawings, a device to protect the hand and wrist when using a hand held power actuated fastener gun 10 is illustrated in FIGS. 1, 2, and 6. The device to protect the hand and wrist when using a hand held power actuated fastener gun 10 generally consists of an adjustable glove 20, a pocket 50, and a padded reinforcement member 70 to protect the wearer's wrist and hand between the wearer's thumb and index finger from the localized repetitive impact associated with operating a hand held power actuated fastener gun 76 powered by gun powder, electricity, pneumatics, and other like sources of power that drives fasteners such as nails, staples, rivets, and other like fasteners.

Referring to FIGS. 1 and 2, the adjustable glove 20 is made of a durable and flexible material 21 such as leather, cloth, or the like, which is capable of covering the lower portion of the forearm 22, wrist 23, and hand 24 having a palm side 25, a back side 26, an open end 27, and a closed end 28. The open end 27 allows the wearer to place the hand 24, wrist 23, and forearm 22 into the adjustable glove 20. FIG. 2 shows that the durable and flexible material 21 is separated on the back side 26 of the adjustable glove 20 forming a gap 29 from the open end 27 of the adjustable glove 20 to about the wrist 23. The gap 29 allows persons of different sizes to secure the adjustable glove 20 on the forearm 22, wrist 23, and hand 24 by either expanding or narrowing the gap 29. The adjustable glove 20 is secured on the wearer's forearm 22, wrist 23, and hand 24 by adjustable fasteners 30 such as Velcro®, laces, or other like fasteners, situated across the gap 29 that runs along the back side 26 of the adjustable glove 20. The closed end 28 of the adjustable glove 20 has a thumb opening 31 for the wearer's thumb 32 to extend through, an index finger opening 33 for the wearer's index finger 34 to extend through, a middle finger opening 35, a ring finger opening 37, and a little finger opening 39.

FIGS. 1 and 2 shows the adjustable glove 20 has a pocket 50 situated on the palm side 25 of the adjustable glove 20 capable of enveloping a padded reinforcement member 70 that extends from forearm 22 to the mid-palm area 51 and across the palm 52 toward the thumb 32, covering both the palm 52 and side of the hand 53 from the first joint of the index finger 54 to the midpoint between the first and second joints of the thumb 55, between the index finger 34 and thumb 32. While the preferred embodiment shows that the padded reinforcement member 70 is secured to the adjustable glove 20 by use of a pocket 50, it is contemplated that the padded reinforcement member 70 maybe secured to the adjustable glove 20 through other structural relationships such as straps or adhesive.

The padded reinforcement member 70, shown in FIG. 3, 4, 5, and 7, fits inside of the pocket 50 of the adjustable glove 20. The padded reinforcement member 70 is made of a rigid material such as steel, aluminum, hard plastic, or other like materials with a thickness of from about 0.015" to about 0.047", and is covered with a padding material 71 such as rubber, foam, or other like materials with a thickness of from about 0.062" to about 0.093". The padded reinforcement member 70 is generally configured to extend from the forearm 22 of the wearer to the mid-palm area 51 of the wearer and across the palm 52 toward the thumb 32, covering both the palm 52 and side of the hand 53 from the from the first joint of the index finger 54 to the midpoint between the first and second joints of the thumb 55, between the index finger 34 and thumb 32.

Figure 3:
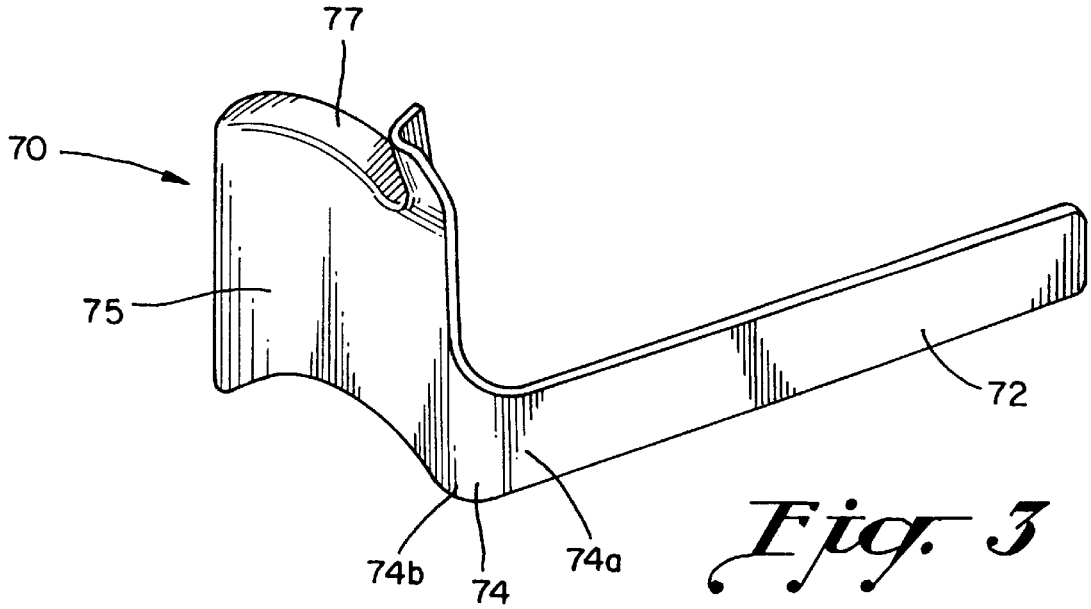
FIG. 3 is a perspective view of the rigid reinforcement member.
Figure 4:
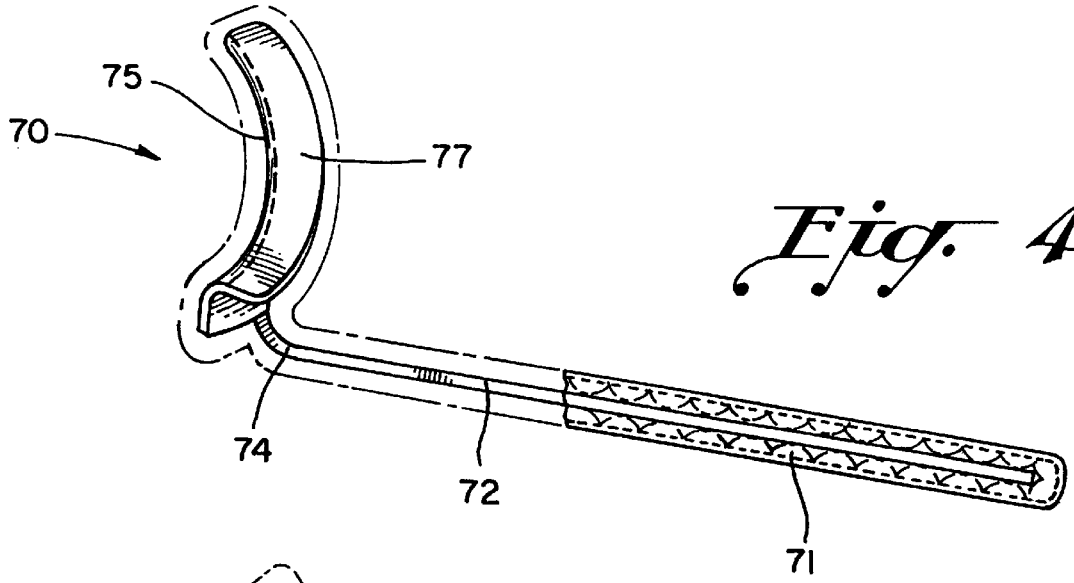
FIG. 4 is a top view of the rigid reinforcement member.
Figure 5:
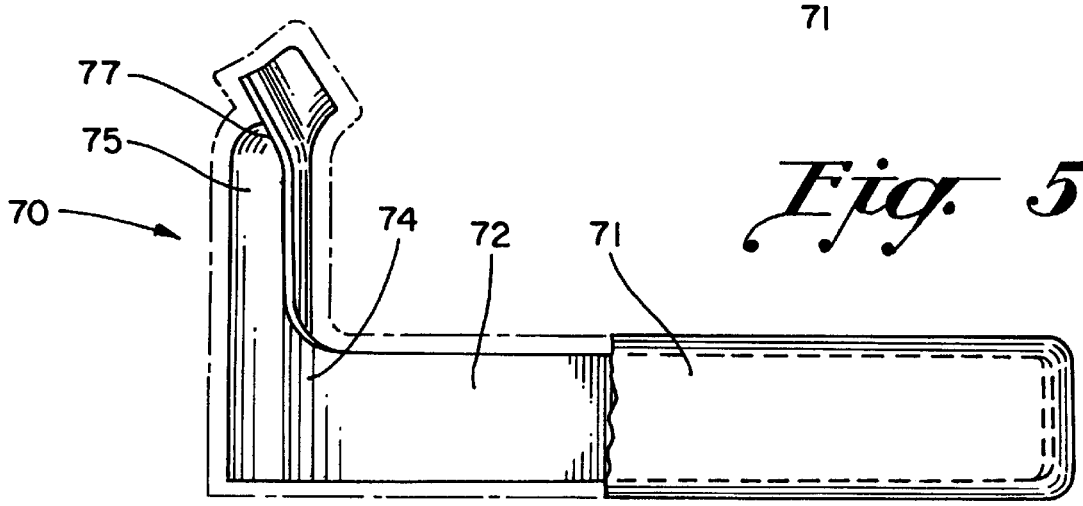
FIG. 5 is a side view of the rigid reinforcement member.
Figure 7:
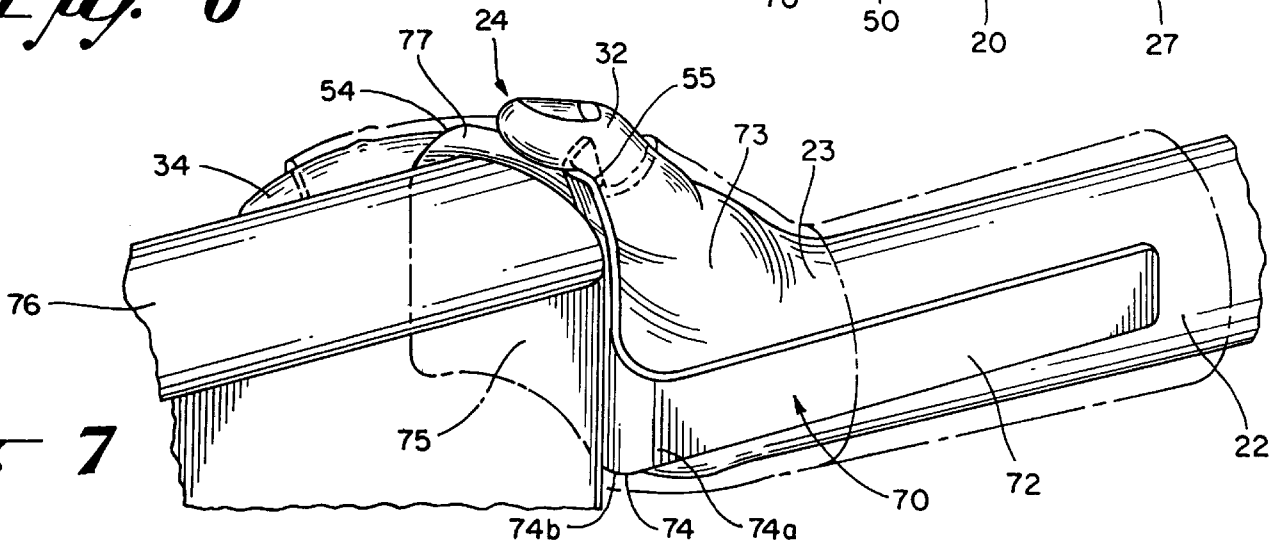
FIG. 7 is a side view of a wearer's hand and a handle from a hand held power actuated fasten gun engaging the rigid reinforcement member.

To achieve this configuration, FIG. 7 shows the portion of the padded reinforcement member 70 that will protect the forearm 22 and the wrist 23 is substantially flat 72 with a width from about 0.875" to about 1.125" and a length from about 4" to about 5". The portion of the padded reinforcement member 70 that will protect the heal of the hand 73 has a first contour 74 to allow the heal of the hand 73 to rest in the first contour 74 that increases from a width from about 0.875" to about 1.125" to a width from about 1.5" to about 1.75" and a length from about 1.5" to about 3". The first contour 74 consists of two angles 74*a* and 74*b*, to accommodate the heal of the hand 73 as shown in FIG. 3. The first angle 74*a*, of no greater than 5 degrees with respect to the plane established by the substantially flat portion of the padded reinforcement member 72, accommodates the slope from the forearm 22 to the heal of the hand 73. The second angle 74*b*, from about 15 degrees to about 25 degrees with respect to the plane established by the substantially flat portion of the padded reinforcement member 72, accommodates the slope from the heal of the hand 73 to the mid-palm area 51. FIG. 7 shows the portion of the padded reinforcement member 70 that will protect the palm 52 has a semi-circular arc 75 configured to accommodate the curved handle design that the hand held power actuated fastener gun 76 commonly has. The semi-circular arc 75 is substantially semi-circular having a radius of about 0.852". The portion of the padded reinforcement member 70 that will protect the side of the hand 53 from the first joint of the index finger 54 to the midpoint between the first and second joints of the thumb 55 has a second contour 77 to approximately match the natural curvature between the index finger 34 and the thumb 32 when holding a hand held power actuated fastener gun 76 with a width of from about 0.375" to about 0.5" and a length from about 2.5" to about 2.75".

The padded reinforcement member 70 protects many of the bones of the hand 24 and wrist 23 including, but not limited to: the first proximal phalange, the sesamoids, the first metacarpal bone of the thumb, the second proximal phalange, the second metacarpal bone of the index finger, the trapezoid, the trapezium capitate, the scaphoid, the lunate, the hamate, the pisiform, the triquetral, the styloid process of radius, and the styloid process of ulna of the upper hand and wrist. The padded reinforcement member 70 also protects many of the muscles of the hand 24 and wrist 23 including, but not limited to: the flexor digitorum profundis, the abductor pollicis, the flexor pollicis longus, the lumbriccales, the abductor digiti minimi, the extensor pollicis longus, the extensor indicis, the extensor pollicis brevis, the extensor carpi radialis brevis, the first and second dorsal interosseous, the extensor retinaculum, the opponens pollicis, the dorsal expansion, the flexor digitorum superficialis, the flexor pollicis brevis, the extensor pollicis brevis, the flexor carpi ulnaris. The padded reinforcement member 70 also protects many of the tendons and nerves of the hand 24 and wrist 23 including, but not limited to: the synovial sheath, the tendon flexor digitorum superficialis, the tendon flexor digitorum profundis, the digital fibrous sheath, the deep transverse metacarpal ligaments, the common synovial sheath, the tendon flexor carpi radialis, the tendon abductor pollicis brevis, the tendon extensor pollicis brevis, the tendon flexor pollicis longus, the tendon extensor carpi radialis longus, the ulnar nerve, and the median nerve.

The padded reinforcement member 70 protect the above mentioned bones, muscles, tendons, and nerves by transferring the recoil impact from the operation of the hand held power actuated fastener gun to the ulna and radius bones of the forearm, and the humerus bone of the upper arm.

I claim:

1. A device to protect a wearer's wrist and portion of hand between the index finger and the thumb when using a hand held power actuated fastener gun, comprising:

a glove made of flexible material capable of covering the wearer's hand, wrist, and a portion of the lower forearm, the glove having a palm side, and a back side;

a gap on the back side of the glove, the gap allowing the wearer to adjust the glove to the wearer's hand, wrist, and lower forearm;

means for securing the glove to the wearer's hand, wrist and lower forearm, the means for securing the glove extending across the gap;

a pocket located on the palm side of the glove;

a rigid reinforcement member engaged in the pocket, the rigid reinforcement member extending from the lower forearm across the palm and toward the thumb covering both the palm and side of the hand from the first joint of the index finger to the midpoint between the first and second joints of the thumb between the index finger and thumb, the rigid reinforcement member providing protection for the wearer's wrist and portion of hand between the index finger and the thumb while operating the hand held power actuated fastener gun.

2. The device of claim 1 wherein the rigid reinforcement member is further defined by:

a substantially flat portion that protects the skin, muscles, tendons, and nerves surrounding the lower radius and ulna of the wearer's forearm;

a first contour adjacent the substantially flat portion that protects the skin, muscles, tendons, and nerves surrounding the scaphoid, trapezium, trapezoid, lunate, triquetrum, pisiform, capitate, and hamate of the wearer's wrist;

a semi-circular arc adjacent the first contour to accept a handle of the hand held power actuated fastener gun that protects the skin, muscles, tendons, and nerves surrounding the metacarpals of the wearer's palm; and a second contour adjacent the semi-circular arc that protects the skin, muscles, tendons, and nerves between the first metacarpal and the second metacarpal.

3. The device of claim 2 further comprising a padding material that covers the rigid reinforcement member.

4. The device of claim 3 wherein the rigid reinforcement member is aluminum, steel, or plastic.

5. The device of claim 3 wherein the padding material is a synthetic foam or rubber.

6. The device of claim 1 wherein the flexible material is cloth or leather.

7. The device of claim 6 wherein the means for securing the glove to the wearer's hand, wrist, and lower forearm, is hook and loop fastener structure.

8. A device to protect a wearer's wrist and portion of hand between the index finger and the thumb when using a hand held power actuated fastener gun, comprising:

a glove made of flexible material capable of covering the wearer's hand, wrist, and a portion of the lower forearm, the glove having a palm side, and a back side;

a rigid reinforcement member secured to the palm side of the glove, the rigid reinforcement member comprising of:

a substantially flat portion that protects the lower forearm;

a first contour adjacent the substantially flat portion that protects the wearer's wrist;

a semi-circular arc adjacent the first contour to accept a handle of the hand held power actuated fastener gun that protects the wearer's palm;

a second contour adjacent the semi-circular arc that protects the wearer's hand between the index finger and the thumb, the rigid reinforcement member providing protection for the wearer's wrist and portion of hand between the index finger and the thumb while operating the hand held power actuated fastener gun.

9. The device of claim 8 further comprising a padding material that covers the rigid reinforcement member.

10. The device of claim 9 wherein the padding material is synthetic foam or rubber.

11. The device of claim 10 wherein the flexible material is cloth or leather.

12. The device of claim 11 further comprising:

a gap on the back side of the glove, the gap allowing the wearer to adjust the glove to the wearer's hand, wrist, and forearm; and means for securing the glove to the wearer's hand, wrist and lower forearm, the means for securing the glove extending across the gap.

13. The device of claim 12 wherein the means for securing the glove to the wearer's hand, wrist, and lower forearm, is hook and loop fastener structure.

14. The device of claim 8 wherein the rigid reinforcement member is aluminum, steel, or plastic.

15. In combination, a rigid reinforcement member and a glove capable of covering a wearer's hand, wrist, and lower forearm having a palm side and a back side, the rigid reinforcement member secured to the palm side extending from the lower forearm across the palm and toward the thumb covering both the palm and side of the hand from the first joint of the index finger to the midpoint between the first and second joints of the thumb between the index finger and thumb, the rigid reinforcement member providing protection for the wearer's wrist and portion of hand between the index finger and the thumb while operating the hand held power actuated fastener gun.

16. The combination of claim 15 wherein the rigid reinforcement member is further defined by:

a substantially flat portion that protects the lower forearm;

a first contour adjacent the substantially flat portion that protects the wearer's wrist;

a semi-circular arc adjacent the first contour to accept a handle of the hand held power actuated fastener gun that protects the wearer's palm;

a second contour adjacent the semi-circular arc that protects the wearer's hand between the index finger and the thumb.

17. The combination of claim 16 further comprising a padding material that covers the rigid reinforcement member.

18. The combination of claim 17 wherein the rigid reinforcement member is aluminum, steel, or plastic.

19. The combination of claim 18 wherein the padding material is synthetic foam or rubber.

20. The combination of claim 19 wherein the glove is made of a flexible material.

21. The device of claim 20 wherein the flexible material is cloth or leather.

22. A device to protect a wearer's wrist and portion of hand between the index finger and the thumb when using a hand held power actuated fastener gun, comprising:

a glove made of flexible material capable of covering the wearer's hand, wrist, and a portion of the lower forearm, the glove having a palm side, and a back side;

a gap on the back side of the glove, the gap allowing the wearer to adjust the glove to the wearer's hand, wrist, and lower forearm;

means for securing the glove to the wearer's hand, wrist and lower forearm, the means for securing the glove extending across the gap;

a pocket located on the palm side of the glove;

a rigid reinforcement member engaged in the pocket, the rigid reinforcement member having a substantially flat portion that protects the skin, muscles, tendons, and nerves surrounding the lower radius and ulna of the wearer's forearm, a first contour adjacent the substantially flat portion that protects the skin, muscles, tendons, and nerves surrounding the scaphoid, trapezium, trapezoid, lunate, triquetrum, pisiform, capitate, and hamate of the wearer's wrist, a semi-circular arc adjacent the first contour to accept a handle of the hand held power actuated fastener gun that protects the skin, muscles, tendons, and nerves surrounding the metacarpals of the wearer's palm, and a second contour adjacent the semi-circular arc that protects the skin, muscles, tendons, and nerves between the first metacarpal and the second metacarpal while operating the hand held power actuated fastener gun;

a padding material, the padding material covering the rigid reinforcement member.

23. The device of claim 22 wherein the rigid reinforcement member is aluminum, steel, or plastic.

24. The device of claim 23 wherein the padding material is synthetic foam or rubber.

25. The device of claim 24 wherein the flexible material is cloth or leather.

26. The device of claim 25 wherein the means for securing the glove to the wearer's hand, wrist, and lower forearm, is hook and loop fastener structure.

* * * * *